United States Patent [19]

Pease

[11] 4,149,554

[45] Apr. 17, 1979

[54] FLUID CONTROL VALVE AND SUPPORT ASSEMBLY

[76] Inventor: James F. Pease, 5805 Folkestone Dr., Dayton, Ohio 45459

[21] Appl. No.: 818,433

[22] Filed: Jul. 25, 1977

[51] Int. Cl.[2] ..... F16K 51/00

[52] U.S. Cl. ..... 137/343; 251/143

[58] Field of Search ..... 251/143, 148; 137/343; 285/158, 189, 192, 193

[56] References Cited

U.S. PATENT DOCUMENTS

| | | | |
|---|---|---|---|
| 2,927,602 | 3/1960 | Elkund | 137/343 |
| 2,936,780 | 5/1960 | Pratt | 137/456 |
| 3,195,561 | 7/1965 | Soviteky | 251/143 |
| 3,357,678 | 12/1967 | Dyki | 285/158 |
| 3,396,848 | 8/1968 | Kozel | 251/143 |
| 3,971,540 | 7/1976 | Johnson et al. | 251/143 |

*Primary Examiner*—Martin P. Schwadron
*Assistant Examiner*—A. Michael Chambers
*Attorney, Agent, or Firm*—Jacox & Meckstroth

[57] ABSTRACT

A solenoid actuated water control valve incorporates a molded plastic valve body which includes an inlet portion defining an inlet chamber and having a plurality of parallel spaced holes for receiving a set of screws. A drawn sheet metal tubular fitting has a tapering tubular threaded portion integrally connected to a radial flange portion. The flange portion corresponds generally to the shape of the inlet portion and has corresponding holes for receiving the screws. The screws also extend through corresponding holes within a support bracket which has an opening for receiving the tubular portion of the fitting so that torque applied to the fitting is transferred through the screws to the support bracket.

9 Claims, 2 Drawing Figures

FLUID CONTROL VALVE AND SUPPORT ASSEMBLY

BACKGROUND OF THE INVENTION

In the art of water control or fill valves commonly used in the appliance industry, it is conventional to use a pilot operated diaphragm which is controlled by a solenoid actuated plunger. In order to reduce costs of such a valve and to eliminate corrosion of the valve, the valve body is molded of thermoplastics material which forms the inlet and outlet portions of the valve body as well as a valve seat for receiving the pilot operated diaphragm. The inlet portion of the valve body defines a cylindrical passage or inlet chamber which is generally surrounded by a plurality of four parallel spaced holes. The holes receive corresponding screws which form threads within the plastic inlet portion of the valve body.

When such a pilot operated valve is used in a built-in appliance, for example, a built-in undercounter dishwashing machine, the valve is usually coupled to a tubular metal fitting such as shown in U.S. Pat. No. 2,936,780, No. 3,195,561 and No. 3,396,848. The tubular metal fitting is machined from solid metal bar stock and is provided with either external or internal pipe threads, for example, as shown in above U.S. Pat. No. 3,195,561 and No. 3,396,848, respectively, so that the fitting may be conveniently coupled to a water supply line.

As disclosed in these two patents, the metal fittings are provided with a shoulder having opposite flat surfaces which mate with corresponding flat edge surfaces of a hole or opening formed within a sheet metal support bracket for the valve. The mating flat surfaces are effective to transfer to the support bracket the torque applied to the fitting by a wrench during installation of the water supply line and thereby avoid transmitting the torque to or through the plastic valve body. The fittings must have substantial wall thickness in the area of the shoulder to prevent collapsing and rotation of the fitting when a substantial torque is applied during installation of a water supply line with a pipe wrench.

It is also common to machine the metal fitting from hexagonal bar stock in order to provide the fitting with a hexagonal flange portion and to provide the sheet metal bracket with an embossed mating hexagonal recess. The recess receives the flange portion to prevent rotation of the fitting relative to the support bracket when torque is applied to the fitting during installation of the water supply line. In order to form the hexagonal recess within the support bracket, it has been found necessary to form the support bracket from relatively heavy gauge sheet metal which significantly increases the cost of the support bracket. In addition, a relatively large press is required to press the hexagonal embossment and recess within the heavy gauge sheet metal.

SUMMARY OF THE INVENTION

The present invention is directed to an improved fluid control valve and support assembly which, as one important feature, significantly decreases the cost of manufacturing the assembly while increasing the resistance to torque applied to the assembly during connection with a water supply line. The control valve coupling and support assembly also provides for higher reliability in that the assembly provides for a more dependable fluid tight seal between the fitting and the inlet portion of a plastic valve body.

In accordance with a preferred embodiment of the invention, the above features and advantages are provided by drawing a sheet of metal to form a fitting having a tapering tubular portion integrally connected to a relatively large radial flange portion. The flange portion is generally rectangular in configuration and corresponds generally to the rectangular configuration of the inlet portion of valve body. The flange portion of the drawn sheet metal tubular fitting is provided with peripherally spaced holes which align with the holes in the inlet portion of the valve body and with corresponding holes within a sheet metal support bracket. Thus the screws which couple the inlet portion of the valve body to the support bracket also extend through the holes within the flange portion of the fitting to provide a high torque resisting connection between the fitting and the support bracket. The tapering tubular portion of the drawn sheet metal fitting is provided with internal threads for connecting the fitting to the water supply line.

Other features and advantages of the invention will be apparent from the following description, the accompanying drawing and the appended claims.

DESCRIPTION OF THE PREFERRED EMBODIMENT

Figure 1:
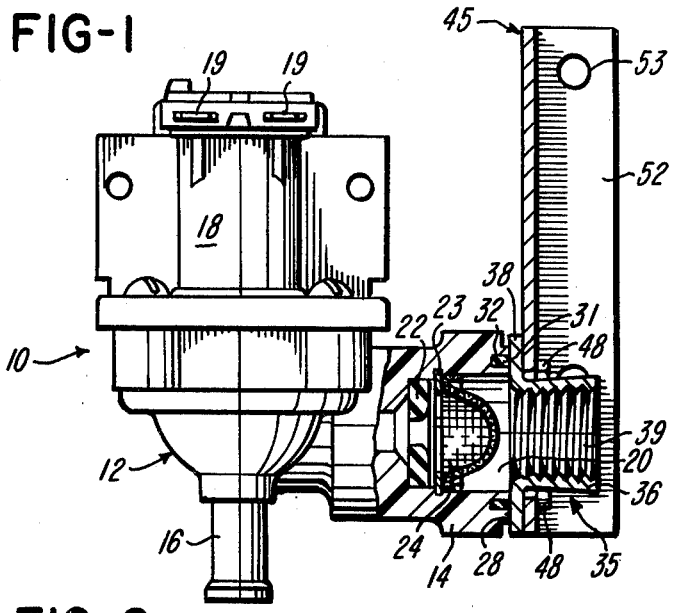
FIG. 1 is an elevational view of a fluid control valve and support assembly constructed in accordance with the invention and with the water inlet portion and support bracket of the assembly shown in section.

Referring to the drawing, FIG. 1 shows a water fill valve 10 of the type which is commonly used on an appliance such as an undercounter automatic dishwashing machine. The valve 10 includes a valve body 12 which is molded from a thermoplastics material and has a tubular inlet portion 14 and a tubular outlet portion 16. In a manner similar to that shown in U.S. Pat. No. 3,396,848 and No. 3,872,878, the valve body 12 also forms a circular valve seat (not shown) through which the flow of water is controlled by movement of a rubber diaphragm (not shown). The diaphragm is pilot operated by actuation of a solenoid 18 which is operated by power supply leads connected to the terminals 19 and automatically controlled by a motor driven timer. The specific construction of the valve 10 forms no part of the present invention.

Figure 2:
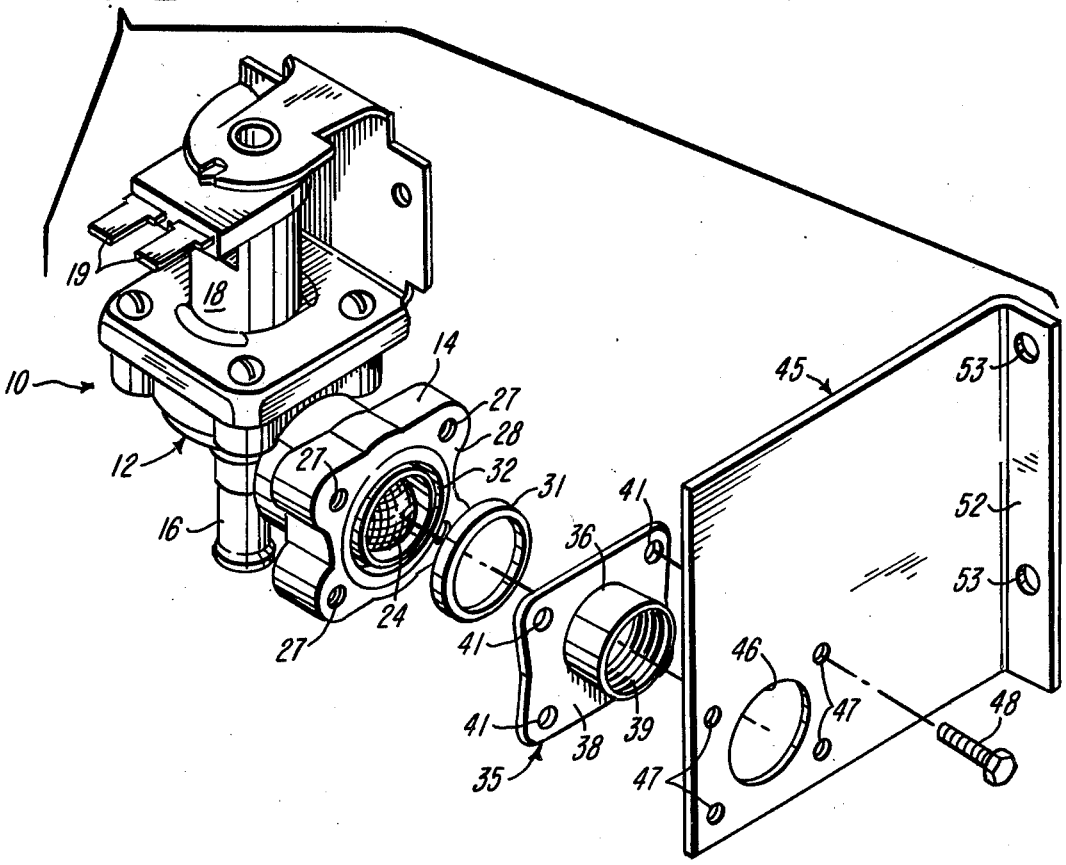
FIG. 2 is an exploded perspective view of the components which form the assembly shown in FIG. 1.

The inlet portion 14 of the molded plastic valve body 12 has a generally rectangular external configuration (FIG. 2) and defines an internal inlet chamber which receives a pressure responsive resilient flow control washer 22, a spring C-type retaining ring 23 and a dome-shaped filter 24 constructed of a stainless steel wire mesh. A set of four parallel holes 27 (FIG. 2) are formed within the inlet portion 14 and are spaced uniformly around the inlet chamber 20. The holes 27 extend from a flat radial face 28 of the inlet portion 14, and a resilient sealing ring 31 is recessed within an annular groove 32 formed within the face 28 concentrically with the inlet chamber 20.

In accordance with the present invention, a tubular inlet fitting 35 is formed by drawing flat sheet metal to form a tubular portion 36 integrally connected to a radial flange portion 38 so that the tubular portion and flange portion have generally a uniform wall thickness.

The tubular portion 36 has a slight tapered or frusto-conical configuration and increases in diameter towards the right end (FIG. 1) of the fitting, and the tubular portion 36 is formed with internal pipe threads 39. The flange portion 38 of the sheet metal fitting 35 has a generally rectangular outer configuration (FIG. 2) which conforms generally to the configuration of the inlet portion 14 of the body 12 and is provided with a corresponding set of holes 41 which align with the holes 27 within the inlet portion.

The fill valve 10 is supported by a formed sheet metal bracket 45 which has a hole or opening 46 for receiving the tubular portion 36 of the fitting 35. The support bracket 45 also has a set of holes 47 which align with the holes 41 in the fitting 35 and with the holes 27 in the inlet portion 14 of the valve body 12. A set of four sheet metal screws 48 extend through the corresponding aligned holes 47 and 41 and form threads within the holes 27 of the plastic inlet portion 14. When the screws 48 are tightened (FIG. 1), the flange portion 38 of the fitting 35 is clamped between the inlet portion 14 of the valve body and the support bracket 45, and the resilient ring 31 forms a fluid-tight seal between the face 28 of the inlet portion 14 and the flange portion 38 of the inlet fitting 35. The support bracket 45 includes a right angle flange portion 52 which is provided with a set of vertically spaced holes 53 for securing the bracket 45 to the frame of the dishwashing machine.

When a water supply line is coupled to the inlet fitting 35, it is apparent that the torque applied to the fitting 35 in response to tightening of a pipe coupling, is transferred through the set of screws 48 to the support bracket 45 so that none of the torque is applied to the plastic valve body 12. Furthermore, as a result of the substantial radial spacing of the holes 41 relative to the center axis of the tubular inlet fitting 35, the fitting 35 can resist substantial torque without any possibility of shearing the screws 48. The construction of the fitting 35 from sheet metal also significantly reduces the manufacturing cost of the fitting in comparison with conventional fittings which are machined from the solid metal bar stock. In addition, the use of the screws 48 for transmitting the torque from the fitting 35 to the support bracket 45 provides for substantial distribution of the torque and permits forming of the support bracket from relatively thin sheet metal, thereby significantly reducing the manufacturing cost of the bracket. The fitting 35 also eliminates the costly operation of embossing the support bracket.

While the form of apparatus herein described and its method of construction constitute a preferred embodiment of the invention, it is to be understood that the invention is not limited to this precise form of apparatus and method, and that changes may be made therein without departing from the scope and spirit of the invention as defined in the appended claims.

The invention having thus been described, the following is claimed:

1. In a valve for controlling the flow of a fluid and including a molded plastic valve body having an inlet portion defining an inlet and an outlet portion defining an outlet and means forming a valve seat therebetween, means supported by said valve body and cooperating with said valve seat for controlling the flow of fluid from said inlet to said outlet, said inlet portion including a plurality of parallel spaced holes disposed generally around said inlet, a metal fitting including a threaded tubular portion projecting from an integral flange portion disposed adjacent said inlet portion of said valve body, means forming a fluid-tight seal between said flange portion and said inlet portion, a rigid support bracket having an aperture for receiving said tubular portion of said fitting and a plurality of holes aligned with said holes within said inlet portion of said valve body, and a plurality of threaded fasteners extending within said holes for securing said bracket to said valve body with said flange portion of said fitting disposed therebetween, the improvement wherein said fitting comprises a drawn sheet metal fitting having a substantially uniform wall thickness, said flange portion of said sheet metal fitting including a plurality of holes aligned with said holes within said support bracket and within said inlet portion of said valve body, and said fasteners extending through said holes within said flange portion of said fitting for transmitting torque from said fitting to said support bracket.

2. A valve as defined in claim 1 wherein said tubular portion has a slight frusto-conical configuration with internal threads.

3. A valve as defined in claim 1 wherein said flange portion of said fitting and said inlet portion of said valve body have substantially the same external configuration.

4. A valve as defined in claim 3 wherein said inlet portion of said valve body and said flange portion of said fitting are generally rectangular in external configuration.

5. A valve as defined in claim 1 wherein said flange portion of said fitting has four of said holes spaced around said tubular portion of said fitting.

6. In a valve for controlling the flow of a fluid and including a molded plastic valve body having an inlet portion defining an inlet and an outlet portion defining an outlet and means forming a valve seat therebetween, means supported by said valve body and including a solenoid for controlling the flow of fluid from said inlet to said outlet, said inlet portion including a plurality of parallel spaced holes disposed generally around said inlet, a metal fitting including a threaded tubular portion projecting from an integral flange portion disposed adjacent said inlet portion of said valve body, means forming a fluid-tight seal between said flange portion and said inlet portion, a rigid support bracket having an aperture for receiving said tubular portion of said fitting and a plurality of holes aligned with said holes within said inlet portion of said valve body, and a plurality of threaded fasteners extending within said holes for securing said bracket to said valve body with said flange portion of said fitting disposed therebetween, the improvement wherein said fitting comprises a drawn sheet metal fitting having a substantially uniform wall thickness, said flange portion of said sheet metal fitting having a generally rectangular configuration and including a plurality of holes aligned with said holes within said support bracket and within said inlet portion of said valve body, said fasteners extending through said holes within said flange portion of said fitting for transmitting torque from said fitting to said support bracket, and said tubular portion of said fitting having internal threads and a slight frusto-conical configuration.

7. In a method of constructing and supporting a valve for controlling the flow of a fluid and including the steps of molding a valve body of plastics material with an inlet portion defining an inlet and an outlet portion defining an outlet and a valve seat therebetween, mounting on said valve body means for controlling the flow of fluid from said inlet to said outlet, forming within said inlet portion a plurality of parallel spaced holes disposed generally around said inlet, forming a metal fitting including a threaded tubular portion projecting from an integral flange portion, positioning said flange portion adjacent said inlet portion of said valve body and forming a fluid-tight seal between said flange portion and said inlet portion, forming a rigid support bracket having an aperture for receiving said tubular portion of said fitting and a plurality of holes aligned with said holes within said inlet portion of said valve body, and extending a plurality of threaded fasteners into said holes for securing said bracket to said valve body with said flange portion of said fitting disposed therebetween, the improvement comprising the steps of drawing a sheet of metal to form said flange portion and said tubular portion of said fitting, forming a plurality of holes within said flange portion spaced generally around said tubular portion and in alignment with said holes within said support bracket and within said inlet portion of said valve body, and extending said fasteners through said holes within said flange portion of said fitting for transmitting torque from said fitting to said support bracket.

8. A method as defined in claim 7 and including the step of forming said tubular portion of said fitting with a slight frusto-conical configuration and internal threads.

9. A method as defined in claim 7 wherein said flange portion of said fitting is formed with a generally rectangular configuration, and four of said holes are formed within the corner portions of said flange portion.

* * * * *